US006037711A

United States Patent [19]

Cathey et al.

[11] Patent Number: 6,037,711

[45] **Date of Patent: *Mar. 14, 2000**

[54] FLAT PANEL DISPLAY ANODE THAT REDUCES THE REFLECTANCE OF AMBIENT LIGHT

[75] Inventors: David A. Cathey, Boise; Charles M. Watkins, Meridian; James J. Hofmann, Boise, all of Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/781,830

[22] Filed: Jan. 10, 1997

[51] Int. Cl.[7] ..... H01J 19/24

[52] U.S. Cl. ..... 313/497; 313/561; 313/308; 313/112

[58] Field of Search ..... 313/483, 466, 313/422, 496, 495, 561, 112, 308, 292, 268, 497; 345/37, 38, 41, 47, 50, 60, 75, 87; 348/786, 790, 791, 796; 359/609, 614, 885, 891; 315/169.4

[56] References Cited

U.S. PATENT DOCUMENTS

| | | | |
|---|---|---|---|
| 4,815,821 | 3/1989 | Nonogaki et al. | 350/164 |
| 4,845,407 | 7/1989 | Ikuta | 315/169 |
| 5,498,925 | 3/1996 | Bell et al. | 313/497 |
| 5,508,584 | 4/1996 | Tsai et al. | 313/497 |
| 5,514,499 | 5/1996 | Iwamatsu et al. | 430/315 |
| 5,545,946 | 8/1996 | Wiemann et al. | 313/496 |
| 5,595,519 | 1/1997 | Huang | 445/24 |
| 5,606,225 | 2/1997 | Levine et al. | 313/497 |
| 5,717,288 | 2/1998 | Huang | 313/496 |

FOREIGN PATENT DOCUMENTS

| | | |
|---|---|---|
| 635 865 | 1/1995 | European Pat. Off. . |
| 61-091838 | 5/1986 | Japan . |

OTHER PUBLICATIONS

Hase, Takashi et al., *Advances in Electronics and Electron Physics*, vol. 79, pp. 352–357, Ed. Peter W. Hawkes, Academic Press, Inc., Jan. 1990.

Gegenwart, Rainer Dr., "Back in the Black," Balzers Process System, *Layers* (Company Newsletter). Issue 2. Business and Technical News from Balzers Process System (Feb. 1996).

*Primary Examiner*—Jay M. Patidar
*Attorney, Agent, or Firm*—Hale and Dorr LLP

[57] ABSTRACT

An anode of a flat panel display has a glass substrate, a patterned black grille on the substrate, a conductive layer covering the grille and the substrate, a phosphor layer covering, and one or more additional transparent layers that reduce the reflectance of the flat panel display from 14% down to 1%–4%. These additional layers are placed between the black matrix grille and the substrate, and between the conductive layer and phosphor layer. The two additional layers are selected and designed to reduce the reflectance that occurs at these respective interfaces.

26 Claims, 1 Drawing Sheet

FLAT PANEL DISPLAY ANODE THAT REDUCES THE REFLECTANCE OF AMBIENT LIGHT

STATEMENT OF GOVERNMENT RIGHTS

This invention was made with Government support under Contract No. DABT63-93-C-0025 awarded by the Advanced Research Projects Agency (ARPA). The Government may have certain rights in this invention.

FIELD OF THE INVENTION

This invention relates to an anode of a flat panel display and to methods for improving an image seen by a viewer of a flat panel display.

BACKGROUND OF THE INVENTION

Flat panel displays include a cathode and an anode, separated with spacers and enclosed in a vacuum. The anode typically includes an outer glass layer and an inner phosphor layer. Emitters in the cathode emit electrons, which strike the phosphor layer on the anode and emit light.

During viewing, ambient light from outside the anode tends to reflect off the glass layer of the anode and the various inner layers of the anode at the intersections between layers. These reflectances reduce contrast and reduce the picture quality as seen by a viewer. The total reflectance of such systems can be as much as 14%, which in some circumstances is unacceptable.

SUMMARY OF THE INVENTION

It is an object of the present invention to improve the image seen by a viewer of a flat panel display by reducing the reflectance of ambient light.

In one aspect of the present invention, the anode of a flat panel display besides having a glass substrate, a patterned black grille on the substrate, a conductive layer covering the grille and the substrate, and a phosphor layer covering, also has one or more additional transparent layers that reduce the reflectance of the flat panel display from 14% down to 1%–4%. These additional layers are placed between the black matrix grille and the substrate, and between the conductive layer and phosphor layer. The two additional layers are selected and designed to reduce the reflectance that occurs at these respective interfaces.

The present invention thus provides anodes for a flat panel display and methods for producing anodes with reduced reflectance and improved contrast. Other features and advantages will become apparent from the following detailed description, drawings, and claims.

DETAILED DESCRIPTION OF PREFERRED EMBODIMENTS

Figure 1:
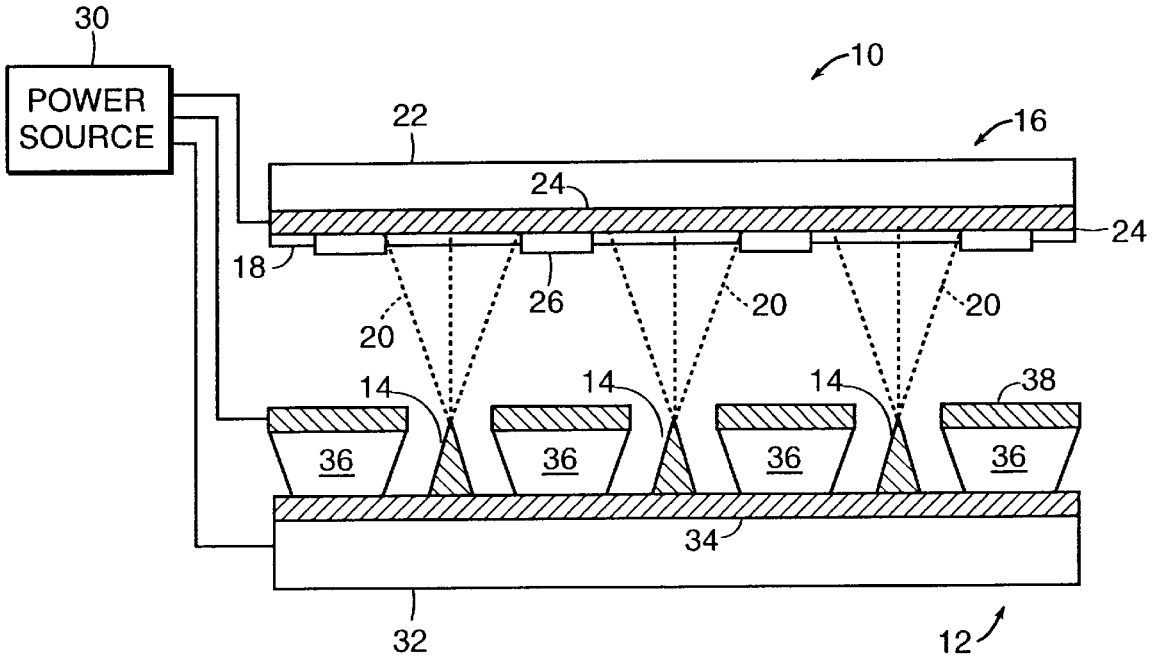
FIG. 1 (PRIOR ART)
FIG. 1 is a cross-sectional view of a known field emission display with a known cathode and anode.

A conventional structure of a known field emission display (FED) is illustrated in FIG. 1. FED 10 has a cathode 12 with an array of conical thin film emitters 14, and an anode 16 with phosphor layer 18 in the open regions defined by patterned black grille 26. When activated, emitters 14 emit electrons 20 to excite phosphor layer 18 to provide a lighted image. Anode 16 and cathode 12 have vacuum gap between them and may be separated with spacers (not shown).

Anode 16 has a glass substrate 22 covered with a transparent conductive layer 24, preferably indium tin oxide (ITO). Over ITO layer 24, patterned black matrix 26, such as cobalt oxide, is deposited as particulates to form a grille. As stated, this grille, defines an array of regions in which phosphor layer 18 is disposed. Alternatively, the black matrix can be patterned on substrate 22. In this embodiment, transparent conductive layer 24 is placed over grille 26 and substrate, and the phosphor layer 18 is disposed on conductive layer.

Cathode 12 has a substrate 32 and a number of conductive layers 34 arranged as strips over the substrate. Conical emitters 14 are formed on conductive layers 34. Dielectric layer 36 surrounds emitters 14. A conductive extraction grid 38 covers dielectric layer 36.

A power source 30 is coupled to conductive layer 24 in anode 16, to extraction grid 38, and to conductive layers 34 in cathode 12. The power source controls the electric field and hence the current and the brightness of the display, and also provides row-column addressing by selectively activating extraction grid 38 and conductive layers 34. When an emitter 14 is activated, electrons are emitted and strike phosphor layer 18.

Figure 2:
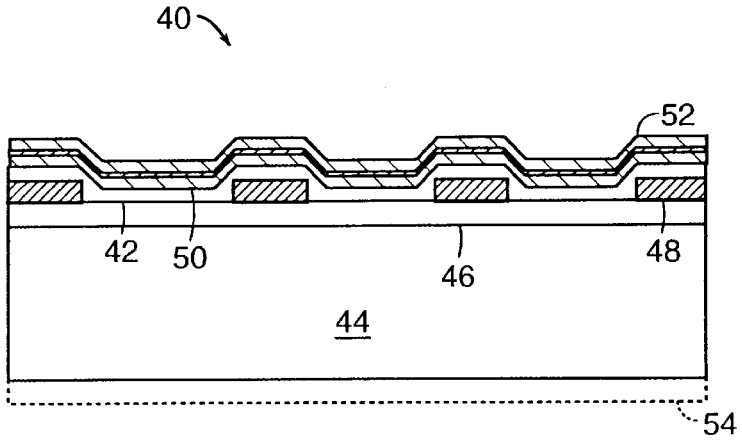
FIG. 2 is a cross-sectional view of an anode for a field emission display according to the present invention.

Referring to FIG. 2, anode 40 of the present invention is shown. This anode may be used with the cathode 12, shown in FIG. 1, or other conventional cathode structure. Anode 40 is constructed to reduce significantly the amount of reflectance of the FED screen. To accomplish this, anode 40 includes one or more additional layers at specific interfaces.

In FIG. 2, glass substrate 44, preferably of soda-lime glass, has a first reflectance reducing layer, in the form of transparent intermediate layer 46, deposited on it. Patterned black grille 48 is deposited on intermediate layer 46 and defines the areas through which the phosphor layer, when excited, will be visible. Preferably, the grille 46 is made from cobalt oxide (CoOx). Transparent conductive layer 42 is deposited over intermediate layer 46 and the patterned black grille 48. As shown, the transparent conductive layer is contoured to the pattern of the black grille. The transparent conductive layer may be ITO layer.

A second reflectance reducing layer, in the form of index matching glass (IMG) layer 50, is disposed on the ITO layer. The IMG layer seeks to transition the refractive index of conductive layer 42 to the refractive index of phosphor layer 52 in such a manner to reduce reflectance at the interface. The IMG layer is followed by phosphor layer 52, preferably of yttria ($Y_2O_3$).

The two additional layers are placed at two interfaces to effect controlled changes in the refractive indexes at these interfaces. The present invention will now be described in greater detail with regard to the two layer that are added.

In order to achieve a total reflectance that is substantially lower than the 14% that has been conventionally experienced, intermediate layer 46 and IMG layer 50 are used. When both of these layers are used, the total reflectance may be reduced to 1%–4%.

The first source of reflectance is at the interface between substrate 22 and patterned black grille 26. This high reflection is caused by the substrate having a refractive index (RI) of 1.51 and the black grille having an RI of 2.9. This is reduced by positioning intermediate layer 46 between the substrate and grille. A desired material for the intermediate layer will be a transparent material that has a refractive index (RI) determined by Expression 1:

$$RI = \sqrt{n_1 \cdot n_2} \quad (1)$$

where, $n_1$=The refractive index of substrate 44.

$n_2$=The refractive index of black grille 48.

The RI determined by Expression 1 will be between the RIs of the grille and substrate.

Once the material for intermediate layer 46 is determined, it is then necessary to determine a preferred physical thickness of the layer. The following will describe the determination of the physical thickness of intermediate layer 46.

The desired optical thickness of intermediate layer 46 is to be equivalent to ¼λ of the center frequency of the visible spectrum, which is nominally 5200 Å. Given this optical thickness, the physical thickness of intermediate layer 46 is determined by Expression 2:

$$\text{Physical Thickness} = \frac{\left(\frac{\text{Optical Thickness}}{4}\right)}{\text{RI Intermediate Layer}} \quad (2)$$

A preferable material for intermediate layer 46 is silicon nitride ($Si_3N_4$) which has a refractive index of 2.1. If silicon nitride is the selected material, its thickness according to Expression (2) will be approximately 619 Å. This determination of thickness is based on an optical thickness of 5200 Å and the refractive index of silicon nitride being 2.1. If a silicon nitride layer that is 619 Å thick is placed between the grille and substrate, the reflectance should be reduced below 5% and, preferably, down to approximately 4%.

ITO 42 covers patterned black grille 48 and intermediate layer 46. Normally, the ITO layer is then covered with the phosphor layer. There is considerable reflectance that occurs at this interface which preferably is eliminated.

To reduce the reflectance between ITO layer 42 and phosphor layer 52, transparent IMG layer 50 is disposed at the interface. The IMG layer serves the purpose of filling the vacuum spaces that exist at this interface and cause reflectance. Preferably, the IMG layer is formed from a low melting point, lead-based glass, such as Corning 1416.

The IMG layer is formed by depositing a layer of glass particles on the ITO layer and then depositing a layer of phosphor material on the IMG layer. The entire structure is then fired at around 525° C. for approximately 20 minutes. This will cause the IMG to flow and eliminate the vacuum spaces between the ITO and phosphor layers. After the IMG layer has been positioned between the ITO and phosphor layers, the reflectance of the FED is further reduced to a range of 1%–4%.

The reflectance can be even further reduced if a separate layer 54 is placed on substrate 44 on the surface opposite the one on which intermediate layer 46 is disposed. This is conventional and this layer may be made from magnesium fluoride (MgF) or silicon dioxide ($SiO_2$).

The terms and expressions which are used herein are used as terms of expression and not of limitation. There is no intention in the use of such terms and expressions of excluding the equivalents of the features shown and described, or portions thereof, it being recognized that various modifications are possible in the scope of the present in the scope of the present invention.

We claim:

1. A flat panel display comprising:

an anode including:

a transparent substrate;

a transparent reflectance reducing intermediate layer disposed on the substrate;

a grille disposed on the intermediate layer with the grille be patterned to define a number of open regions;

a conductive layer disposed over the grille and intermediate layer; and phosphor layer disposed on the conductive layer.

2. The display of claim 1, wherein the transparent substrate includes soda-lime glass.

3. The display of claim 1, wherein a refractive index for the intermediate layer is determined by the Expression:

$$RI = \sqrt{n_1 \cdot n_2} \quad (1)$$

where, $n_1$=The refractive index of substrate;

$n_2$=The refractive index of grille.

4. The display of claim 1, wherein thickness of the intermediate layer is determined by the Expression:

$$\text{Physical Thickness} = \frac{\left(\frac{\text{Optical Thickness}}{4}\right)}{\text{RI Intermediate Layer}} \quad (2)$$

where,

Optical thickness=¼λ of a center frequency of a visible spectrum.

5. The display of claim 1, wherein the intermediate layer is formed of silicon nitride.

6. The display of claim 1, further comprising a cathode having a plurality of selectively activatable emitters.

7. The display of claim 1, wherein a total reflectance of the flat panel display is below 5%.

8. A flat panel display comprising:

an anode including:

a transparent substrate;

a transparent reflectance reducing intermediate layer disposed on the substrate;

a grille disposed on the intermediate layer with the grille being patterned to define a number of open regions;

a conductive layer disposed over the grille and intermediate layer;

a transparent reflectance reducing glass layer disposed on the conductive layer; and a phosphor layer disposed on the glass layer.

9. The display of claim 8, wherein the transparent substrate includes soda-lime glass.

10. The display of claim 8, wherein a reflectance index for a suitable material for the intermediate layer is determined by the Expression:

$$RI = \sqrt{n_1 \cdot n_2} \quad (1)$$

where, $n_1$=The refractive index of substrate;

$n_2$=The refractive index of grille.

11. The display of claim 10, wherein a thickness of the intermediate layer is determined by the Expression:

$$\text{Physical Thickness} = \frac{\left(\frac{\text{Optical Thickness}}{4}\right)}{\text{RI Intermediate Layer}} \quad (2)$$

where,

Optical thickness=¼λ of a center frequency of a visible spectrum.

12. The display of claim 8, wherein the intermediate layer is formed of silicon nitride.

13. The display of claim 8, further comprising a cathode having a plurality of selectively activatable emitters.

14. The display of claim 8, wherein a total reflectance of the flat panel display is below 5%.

15. The display of claim 8, wherein the reflectance reducing glass includes a lead-based glass.

16. The display of claim 15, where the reflectance reducing glass has a melting point less than a melting point of the conductive layer.

17. The display of claim 16, wherein the reflectance reducing glass has a melting point at or below 525° C.

18. The display of claim 8, wherein a total reflectance of the flat panel display is in a range of 1%–4%.

19. The display of claim 8, wherein a transparent third reflectance reducing layer is disposed on the substrate on a surface opposite a surface on which the intermediate layer is disposed.

20. The display of claim 19, wherein the third reflectance reducing layer is formed of magnesium floride.

21. The display of claim 19, wherein the third reflectance reducing layer of silicon dioxide.

22. The display of claim 1 wherein the phosphor layer is continuous.

23. The display of claim 8 wherein the phosphor layer is continuous.

24. The display of claim 1 wherein the transparent reflectance reducing intermediate layer is silicon nitride of approximately 600 angstroms thickness.

25. The display of claim 8 wherein the transparent reflectance reducing intermediate layer is silicon nitride of approximately 600 angstroms thickness.

26. A flat panel display comprising:

a cathode;

an anode having a grille patterned to define a number of open regions;

a reflectance reducing layer; and a transparent layer;

wherein the reflectance reducing layer is disposed between the transparent layer and the grille and is made of a material and has a thickness to reduce the refractive discontinuity between the grille and the transparent layer.

* * * * *